US009197964B2

(12) United States Patent
Gotoh et al.

(10) Patent No.: US 9,197,964 B2
(45) Date of Patent: Nov. 24, 2015

(54) AMPLIFIER UNIT AND MOBILE ELECTRONIC DEVICE PROVIDED WITH THE AMPLIFIER UNIT

(71) Applicant: TEAC Corporation, Tami-shi, Tokyo (JP)

(72) Inventors: Hideaki Gotoh, Koshigaya (JP); Kazuki Ida, Tama (JP)

(73) Assignee: TEAC Corporation, Tokyo (JP)

( * ) Notice: Subject to any disclaimer, the term of this patent is extended or adjusted under 35 U.S.C. 154(b) by 315 days.

(21) Appl. No.: 13/750,856

(22) Filed: Jan. 25, 2013

(65) Prior Publication Data

US 2014/0064497 A1 Mar. 6, 2014

(30) Foreign Application Priority Data

Aug. 30, 2012 (JP) ..... 2012-189760

(51) Int. Cl.

| | |
|---|---|
| ***H04R 5/00*** | (2006.01) |
| ***H04H 40/81*** | (2008.01) |
| ***H04R 5/04*** | (2006.01) |
| *H04R 5/027* | (2006.01) |

(52) U.S. Cl.

CPC .. *H04R 5/04* (2013.01); *H04R 5/00* (2013.01); *H04R 5/027* (2013.01); *H04R 2430/01* (2013.01); *H04R 2499/11* (2013.01)

(58) Field of Classification Search

None

See application file for complete search history.

(56) References Cited

U.S. PATENT DOCUMENTS

2005/0259828 A1* 11/2005 Van den Berghe ..... 381/23

FOREIGN PATENT DOCUMENTS

| | | |
|---|---|---|
| JP | 7288162 A | 10/1995 |
| JP | 2006033615 A | 2/2006 |

* cited by examiner

*Primary Examiner* — Andrew L Sniezek

(74) *Attorney, Agent, or Firm* — Seed IP Law Group PLLC

(57) ABSTRACT

An amplifier unit suitable for a wide variety of uses, which can flexibly support diverse sound recording scenarios, and a mobile electronic device provided with the amplifier unit. An amplifier unit has microphone/line input terminals respectively provided on the topside surface and the left side surface. When a connector is connected to a mobile electronic device, stereophonic sound is recorded using one of the terminals when the mobile electronic device is held in portrait orientation, and using the other terminal when the mobile electronic device is held in landscape orientation. It is possible to switch each of audio signals coming through the two terminals between monophonic and stereophonic.

8 Claims, 8 Drawing Sheets

AMPLIFIER UNIT AND MOBILE ELECTRONIC DEVICE PROVIDED WITH THE AMPLIFIER UNIT

PRIORITY INFORMATION

This application claims priority to Japanese Patent Application No. 2012-189760, filed on Aug. 30, 2012, which is incorporated herein by reference in its entirety.

BACKGROUND

1. Technical Field

The present invention relates to an amplifier unit and a mobile electronic device provided with the amplifier unit.

2. Related Art

Recently, multifunctional mobile electronic devices such as mobile phones, tablet terminals, and PDAs have become widely popular. Such mobile electronic devices may be used for the purpose of recording sound or recording video. However, because most mobile electronic devices are not dedicated to recording sound (or recording video), a microphone suitable for recording sound is not mounted in many cases. With this being the situation, stereophonic microphone devices attachable as desired to such mobile electronic devices have been proposed.

On the other hand, various types of microphone devices or stereophonic input and output devices are known, although they are not stereophonic microphone devices specifically attachable to mobile electronic devices.

JP 07-288162 A discloses a stereophonic input and output device having an L channel input terminal and an R channel input terminal arranged on the same surface, wherein, when both of the input terminals are in connection, a signal is input and output as a stereophonic balanced signal, and when only one of the input terminals is in connection, a signal is input and output as a stereophonic unbalanced signal.

JP 2006-033615 A discloses a sound pickup device capable of changing the orientation of a microphone in accordance with the purpose of use, and discloses switching between stereophonic sound recording and monophonic sound recording in accordance with the position of the microphone relative to the main body of the sound pickup device.

In order to increase the sound quality of a stereophonic microphone device attached to a mobile electronic device, an amplifier unit comprising an analog-to-digital converter, an input volume control capable of adjusting an input level, and other components, to which an external stereophonic device can be connected as desired, is contemplated. In consideration of the fact that such an amplifier unit is attached to a mobile electronic device, flexibility is desired such that the amplifier unit can support diverse sound recording scenarios.

SUMMARY

The present invention provides an amplifier unit suitable for a wide variety of uses, which can flexibly support diverse sound recording scenarios, and a mobile electronic device provided with the amplifier unit.

According to one aspect of the present invention, there is provided an amplifier unit comprising first and second audio signal input terminals respectively formed on at least two different surfaces; switching means capable of switching whether to process each of audio signals coming through the first and second audio signal input terminals as a monophonic audio signal or as a stereophonic signal, wherein, when the audio signals are processed as monophonic audio signals, a monophonic audio signal coming through the first audio signal input terminal and a monophonic audio signal coming through the second audio signal input terminal are paired as a stereophonic audio signal; analog-to-digital conversion means for converting an audio signal coming through the switching means into a digital audio signal; and output means for outputting the digital audio signal.

According to one embodiment of the present invention, the amplifier unit further comprises level adjustment means for adjusting an input level of each of audio signals coming through the first and second audio signal input terminals, the level adjustment means comprising first and second operation knobs which are in frictional engagement with each other, and rotate about the same axis, wherein the first operation knob adjusts an input level of an audio signal coming through the first audio signal input terminal, the second operation knob adjusts an input level of an audio signal coming through the second audio signal input terminal, operation of one operation knob to rotate causes the other operation knob to also rotate correspondingly in a linked manner, and while one operation knob is being kept in a fixed state, the other operation knob is capable of being independently operated to rotate.

According to another embodiment of the present invention, when switching to a stereophonic signal is performed, the switching means outputs either a signal coming through the first audio signal input terminal or a signal coming through the second audio signal input terminal as a stereophonic signal.

According to still another embodiment of the present invention, when a microphone is connected to one of the first audio signal input terminal and the second audio signal input terminal, the switching means switches to process a signal coming through the input terminal to which the microphone is connected, as a stereophonic signal, and when microphones are connected to both of the first audio signal input terminal and the second audio signal input terminal, the switching means switches to process each of signals coming through the first audio signal input terminal and the second audio signal input terminal to which the microphones are connected, as a monophonic signal, and outputs a pair of a monophonic audio signal coming through the first audio signal input terminal and a monophonic audio signal coming through the second audio signal input terminal as a stereophonic audio signal. Switching performed by the switching means may be either automatic or manual.

According to still another embodiment of the present invention, the amplifier unit comprises a connector for connecting the amplifier unit to a mobile electronic device.

The amplifier unit according to the present invention can be incorporated in a mobile electronic device such as a mobile phone, a personal digital assistant (PDA), or a digital camera, and the present invention includes such a mobile electronic device.

By employing the present invention, it is possible to obtain an amplifier unit suitable for a wide variety of uses, which can flexibly support diverse sound recording scenarios, and a mobile electronic device provided with the amplifier unit.

BRIEF DESCRIPTION OF THE DRAWINGS

Preferred embodiment(s) of the present invention will be described in detail based on the following figures, wherein.

DETAILED DESCRIPTION

An embodiment of the present invention will be described below with reference to the drawings.

Figure 1:
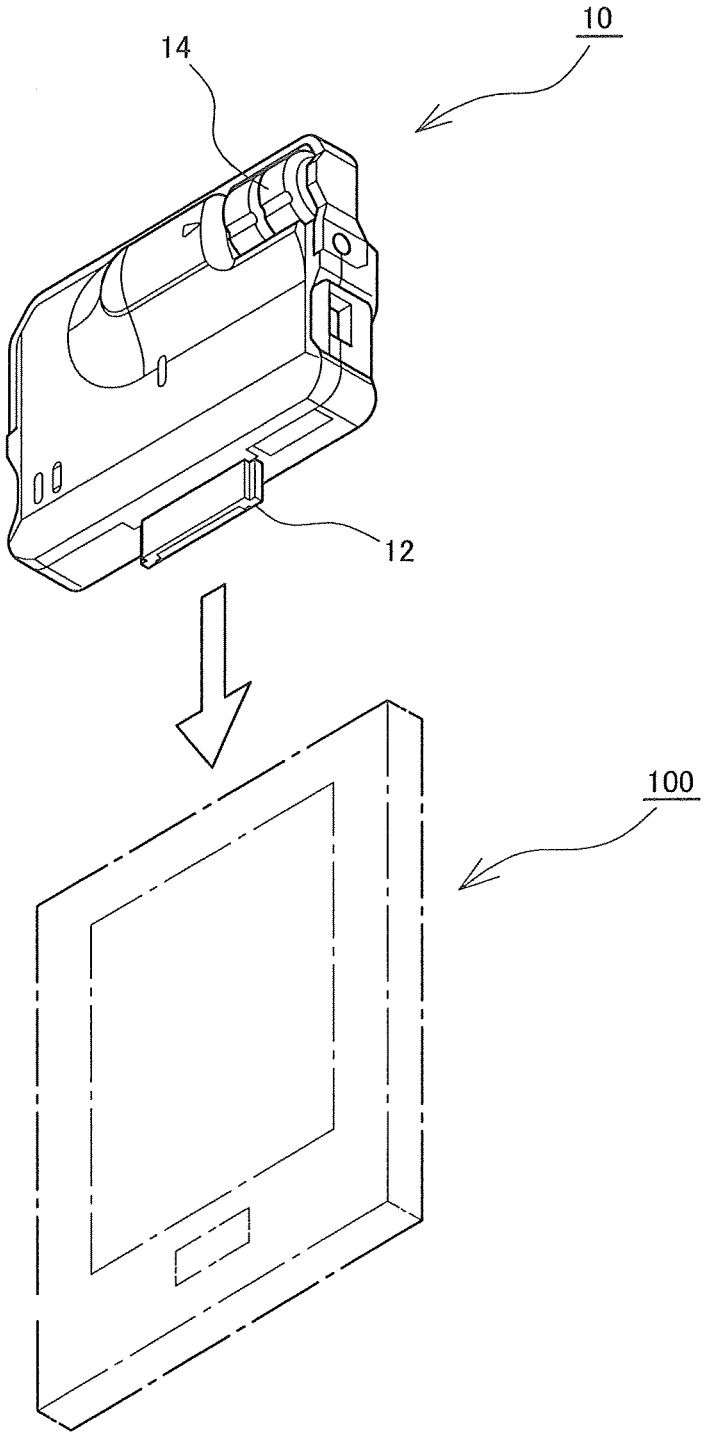
FIG. 1 is an external perspective view of an amplifier unit according to an embodiment of the present invention.

FIG. 1 is an external perspective view of an amplifier unit 10 according to an embodiment of the present invention. The amplifier unit 10 forms a substantially rectangular parallelepiped shape having six surfaces in overall shape. The amplifier unit 10 has a connector 12 formed on the bottom surface thereof, and is configured to be connectable to a mobile electronic device 100 such as a mobile phone, a tablet terminal, a personal digital assistant, or a digital camera.

The amplifier unit 10 is provided with a plurality of audio signal input terminals for connection to an external microphone or various types of musical instruments. The plurality of audio signal input terminals are formed on at least two different surfaces of the six surfaces of the amplifier unit 10, and in this embodiment are respectively provided on the topside surface and the left side surface. Into these audio signal input terminals, a jack for an external microphone is inserted, or a line jack for allowing audio signals to be input from various types of musical instruments such as a guitar or a drum kit is inserted. In the following description, these audio signal input terminals are referred to as a microphone/line input terminal, which represents a terminal for receiving input from either a microphone or a line.

Further, an input volume control 14 for adjusting levels of audio signals input from the microphone/line input terminals is provided at a predetermined position, or at the front right corner, of the amplifier unit 10. The input volume control 14 is composed of two dial-type knobs, the two dial-type knobs basically respectively corresponding to the two microphone/line input terminals, and by operating this input volume control 14 a user can adjust levels of audio signals input from the microphone/line input terminals as desired.

Further, a switch for switching between the microphone/line input terminals is provided on the back of the amplifier unit 10. The switch is composed of an input terminal switching switch for selectively switching between the two microphone/line input terminals and a mode switching switch for switching between monophonic and stereophonic modes.

As will be described below, the amplifier unit 10 includes an ADC (analog-to-digital converter circuit) and an audio signal processing circuit. The amplifier unit 10 converts an audio signal input from a microphone or a line into a digital signal, and outputs the digital audio signal to a mobile electronic device 100 connected via a connector.

An example of the mobile electronic device is a smartphone which is a multifunctional mobile phone. The amplifier unit 10 is connected to a smartphone, and the digital audio signal is supplied from the amplifier unit 10 via a connector to the smartphone. In the smartphone, it is possible to record sound by, for example, recording the digital audio signal supplied from the amplifier unit 10 in an internal memory. When the smartphone has the function of capturing motion video, by capturing motion video on the smartphone side, and receiving the digital audio signal from the amplifier unit 10, it is also possible to record the sound together with the motion video.

Figure 2A:
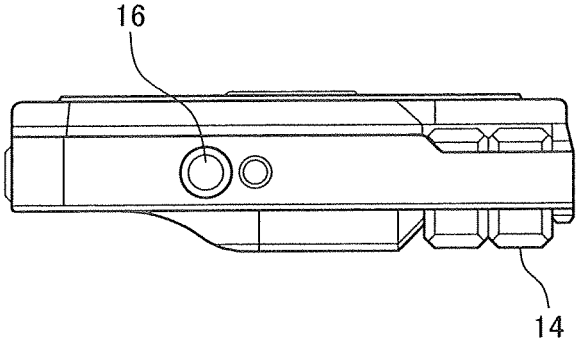
FIG. 2A is a top view of the amplifier unit according to the embodiment.
Figure 2B:
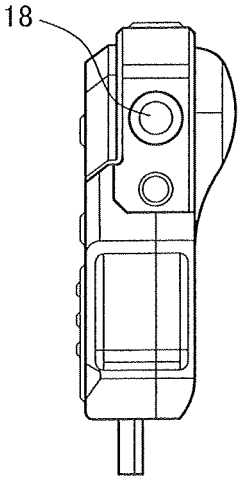
FIG. 2B is a left side view of the amplifier unit according to the embodiment.
Figure 2C:
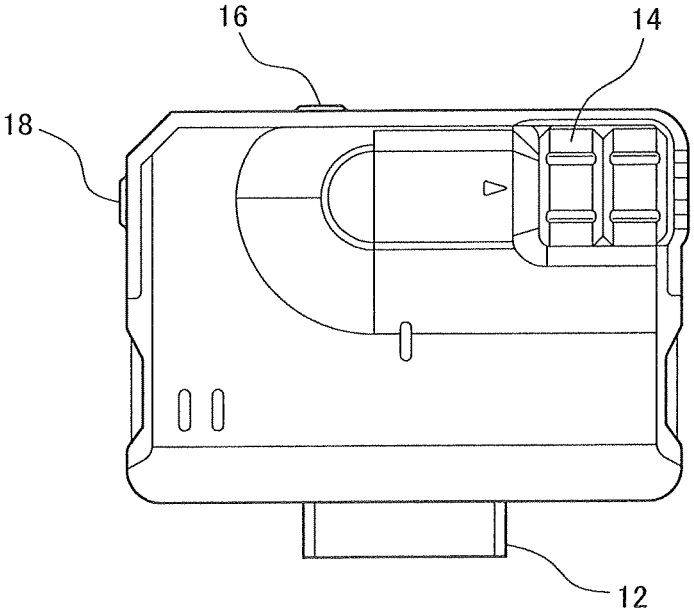
FIG. 2C is a plan view of the amplifier unit according to the embodiment.

FIGS. 2A, 2B, and 2C show an external structure of the amplifier unit 10, in which FIG. 2A is a top view, FIG. 2B is a left side view, and FIG. 2C is a plan view. As shown in FIG. 2A, a microphone/line input terminal 16 is provided on the topside surface of the amplifier unit 10. Although, in FIG. 2A, the microphone/line input terminal 16 is provided at a position shifted toward the left from approximately the center of the topside surface, this is because the position at which it is formed is adjusted due to the relationship with an internal structure of the amplifier unit 10. The microphone/line input terminal 16 may also be provided at the front central position. Further, as shown in FIG. 2B, another microphone/line input terminal 18 is provided on the left side surface of the amplifier unit 10. The microphone/line input terminal 18 may also be provided at any position, as for the microphone/line input terminal 16. Because the microphone/line input terminal 16 is provided on the topside surface of the amplifier unit 10, and the microphone/line input terminal 18 is provided on the left side surface of the amplifier unit 10, as shown in FIG. 2C, when the amplifier unit 10 is viewed in a plan view, the microphone/line input terminal 16 is present on the upper side of the amplifier unit 10, and the microphone/line input terminal 18 is present on the left side of the amplifier unit 10. The user can insert a jack for an external microphone or a line jack into one of the microphone/line input terminal 16 and the microphone/line input terminal 18. Further, the user can insert a jack for an external microphone or a line jack into both of the microphone/line input terminal 16 and the microphone/line input terminal 18.

Figure 3:
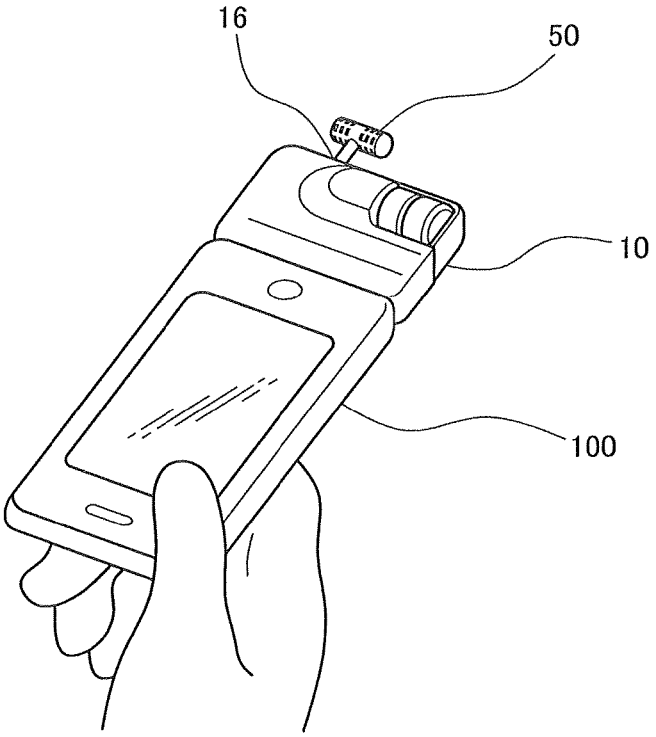
FIG. 3 illustrates connection of an external stereophonic microphone device for a case where a mobile electronic device is held in portrait orientation.

FIG. 3 shows an example of a state of operation in which the amplifier unit 10 is connected to the mobile electronic device 100. A case where the mobile electronic device 100 is held in portrait orientation to capture motion video is shown. In this case, in consideration of the fact that the mobile electronic device 100 is in portrait orientation, the user inserts a jack for an external stereophonic microphone 50 into the microphone/line input terminal 16 of the amplifier unit 10. The external microphone 50 has an R channel microphone unit and an L channel microphone unit, and inputs a stereophonic signal by picking up sound from the right and the left using both microphone units. By inserting the jack for the external stereophonic microphone 50 into the microphone/line input terminal 16 of the amplifier unit 10, when the user holds the mobile electronic device 100 in portrait orientation, the R channel microphone unit and the L channel microphone unit of the external microphone 50 are optimally positioned right and left with respect to a target from which sound is to be picked up, and sound can be picked up in the normal stereophonic position.

Figure 4:
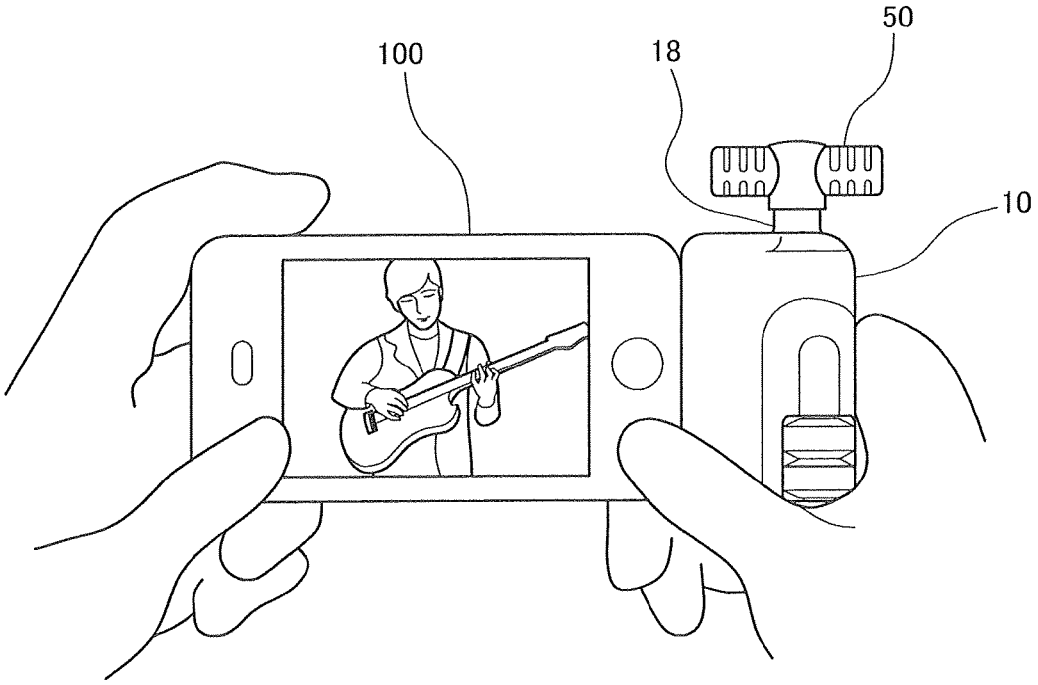
FIG. 4 illustrates connection of an external stereophonic microphone device for a case where a mobile electronic device is held in landscape orientation.

On the other hand, FIG. 4 shows another example of a state of operation in which the amplifier unit 10 is connected to the mobile electronic device 100. A case where the mobile electronic device 100 is held in landscape orientation to capture motion video is shown. Although, when the mobile electronic device 100 is to be operated while being held in portrait orientation, the user attaches the external stereophonic microphone 50 to the microphone/line input terminal 16 as described above so that sound can be picked up in the normal stereophonic position, if the mobile electronic device 100 is rotated into landscape orientation with the external stereophonic microphone 50 being attached to the microphone/line input terminal 16, because the R channel microphone unit and the L channel microphone unit of the external microphone 50 are placed in the vertical direction, sound cannot be picked up in the normal stereophonic position without modifying the present configuration.

To address this situation, as shown in FIG. 4, the external stereophonic microphone 50 is attached to the microphone/line input terminal 18. When the mobile electronic device 100 is held in landscape orientation, the left side surface of the amplifier unit 10 connected to the mobile electronic device 100 comes to the upper side. By attaching the external stereophonic microphone 50 to the microphone/line input terminal 18 provided on the left side surface of the amplifier unit 10, the R channel microphone unit and the L channel microphone unit of the external stereophonic microphone 50 are positioned in the horizontal direction, and sound can be picked up in the normal stereophonic position.

As described above, by providing the microphone/line input terminal 16 on the topside surface of the amplifier unit 10, and providing the microphone/line input terminal 18 on the left side surface of the amplifier unit 10, when the mobile electronic device 100 to which the amplifier unit 10 is connected is held in portrait orientation, because the microphone/line input terminal 16 provided on the topside surface of the amplifier unit 10 faces upward, stereophonic sound pickup can be performed by attaching the external stereophonic microphone 50 to the microphone/line input terminal 16, and on the other hand, when the mobile electronic device 100 to which the amplifier unit 10 is connected is held in landscape orientation, because the microphone/line input terminal 18 provided on the left side surface of the amplifier unit 10 faces upward, stereophonic sound pickup can be performed by attaching the external stereophonic microphone 50 to the microphone/line input terminal 18. In other words, regardless of whether the user holds the mobile electronic device 100 in landscape orientation or in portrait orientation, stereophonic sound pickup and stereophonic sound recording can be performed using the amplifier unit 10.

Further, according to the present embodiment, it is also possible to attach an external microphone to each of the microphone/line input terminal 16 and the microphone/line input terminal 18, rather than attaching an external microphone to one of the microphone/line input terminal 16 and the microphone/line input terminal 18.

Figure 5:
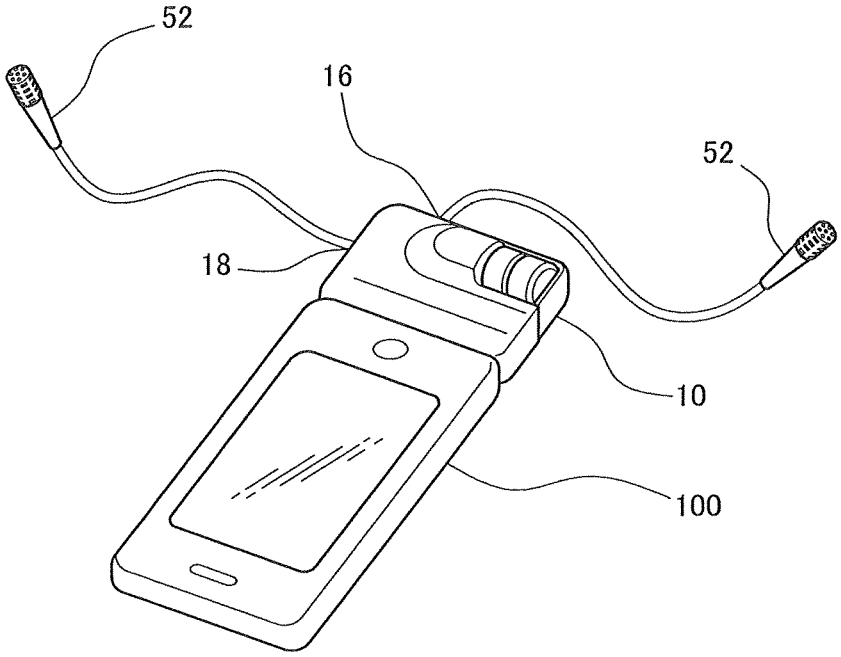
FIG. 5 illustrates connection for a case where stereophonic sound is recorded using two microphone devices.

FIG. 5 shows an example of a state of operation for the above-described case. An external stereophonic microphone 52 is attached to the microphone/line input terminal 16, and an external stereophonic microphone 52 is attached to the microphone/line input terminal 18. In this case, the amplifier unit 10 processes an audio signal coming through the microphone/line input terminal 16 not as a stereophonic signal but as a monophonic signal, and processes an audio signal coming through the microphone/line input terminal 18 not as a stereophonic signal but as a monophonic signal. The signals are then processed as a stereophonic signal composed of a pair of a monophonic signal coming through the microphone/line input terminal 16 and a monophonic signal coming through the microphone/line input terminal 18. For example, in FIG. 5, a monophonic signal coming through the microphone/line input terminal 16 is used as an R channel signal, a monophonic signal coming through the microphone/line input terminal 18 is used as an L channel signal, and the two signals in a pair are processed as a stereophonic signal.

As described above, by using a stereophonic signal composed of an audio signal coming through the microphone/line input terminal 16 and an audio signal coming through the microphone/line input terminal 18, diverse and flexible stereophonic sound pickup can be performed. Specifically, for example, when a sound source is present at a position from which stereophonic sound cannot be picked up using the external stereophonic microphone 50 attached to the microphone/line input terminal 18, by picking up sound using an external stereophonic microphone 52 attached to the microphone/line input terminal 16 and an external stereophonic microphone 52 attached to the microphone/line input terminal 18 as shown in FIG. 5, stereophonic sound pickup can be enabled. It should be understood that by independently changing or adjusting the directivity of the external stereophonic microphone 52 attached to the microphone/line input terminal 16 and the external stereophonic microphone 52 attached to the microphone/line input terminal 18, in combination with the feature that the two microphones can be spaced apart, sound can be picked up from sound sources located at various positions.

When the external stereophonic microphone 50 is attached to one of the microphone/line input terminal 16 and the microphone/line input terminal 18, the microphone/line input terminal 16 and the microphone/line input terminal 18 serve as a terminal for inputting a stereophonic signal. When an external stereophonic microphone 52 is attached to each of the microphone/line input terminal 16 and the microphone/line input terminal 18, the microphone/line input terminal 16 and the microphone/line input terminal 18 serve as terminals for respectively inputting monophonic signals so that the two terminals serve as a pair of terminals for inputting a stereophonic signal. Such monophonic/stereophonic switching may be performed automatically upon detection by a processor in the amplifier unit 10, or the user may switch manually using a switching switch provided on the amplifier unit 10. According to the present embodiment, a structure wherein the user operates the input terminal switching switch and the mode switching switch provided on the back of the amplifier unit 10 to switch the function of the microphone/line input terminal 16 and the microphone/line input terminal 18 will be described.

Figure 6:
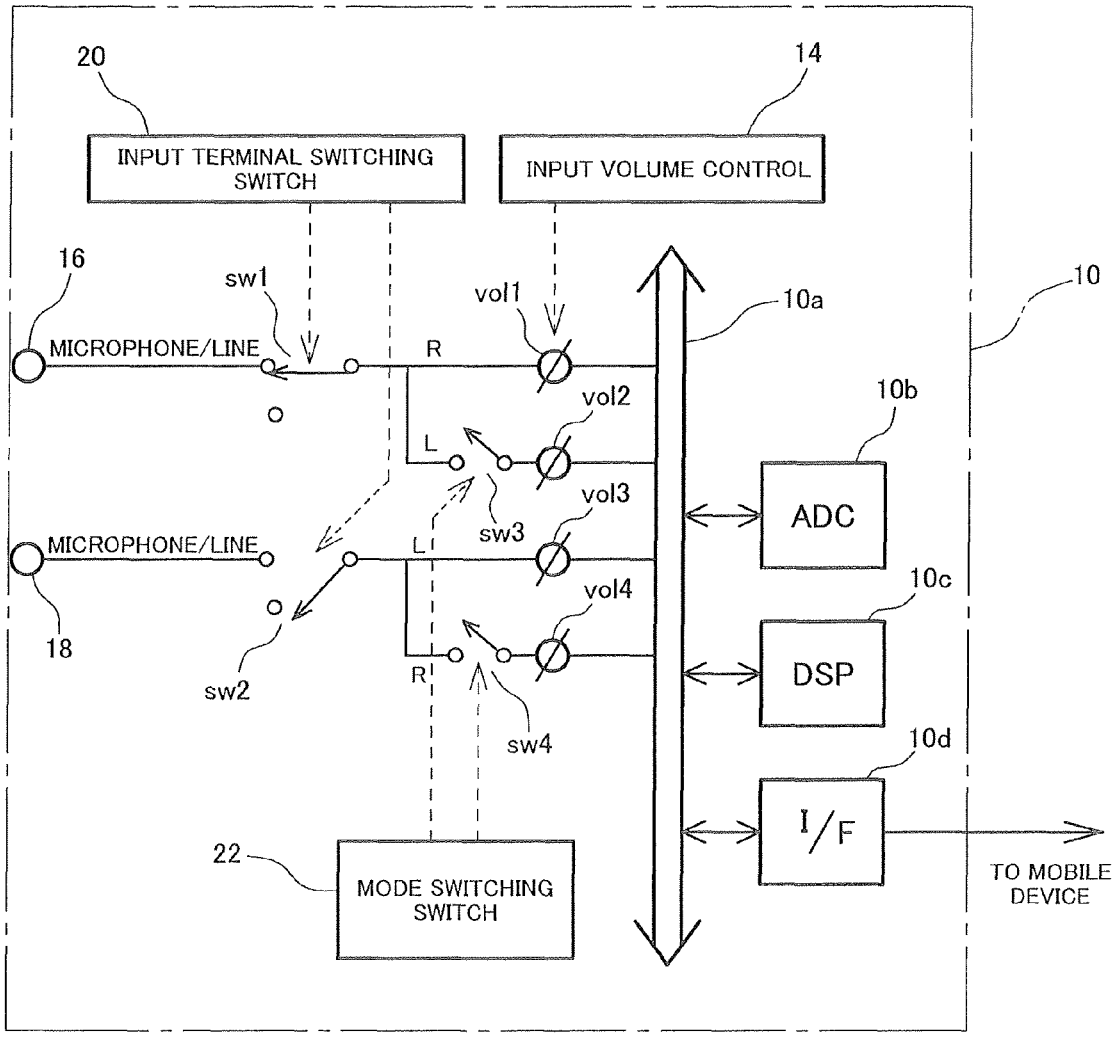
FIG. 6 is a circuit structure diagram of the amplifier unit according to the embodiment.

FIG. 6 shows a circuit structure diagram of the amplifier unit 10. The amplifier unit 10 includes microphone/line input terminals 16 and 18, an input volume control 14, an input terminal switching switch 20, a mode switching switch 22, switches SW1 to SW4, input volume control switches Vol1 to Vol4, a signal bus 10*a*, an analog-to-digital converter circuit (ADC) 10*b*, a digital signal processor (DSP) 10*c*, and an interface (I/F) 10*d*.

The microphone/line input terminal 16 is connected to a contact of SW1. Further, the microphone/line input terminal 18 is connected to a contact of SW2.

SW1 and SW2 are linked to the input terminal switching switch 20 provided on the back of the amplifier unit 10. When the user operates the input terminal switching switch 20 to switch it to the microphone/line input terminal 16 side, SW1 switches to the microphone/line input terminal 16 side contact, and on the other hand, SW2 switches to the OFF side contact. Further, when the user operates the input terminal switching switch 20 to switch it to the microphone/line input terminal 18 side, SW1 switches to the OFF side contact, and on the other hand, SW2 switches to the microphone/line input terminal 18 side contact. In FIG. 6, a case where the user operates the input terminal switching switch 20 to select the microphone/line input terminal 16 is shown. In this case, SW1 is ON, and SW2 is OFF.

An audio signal coming through SW1 is separated into an R channel audio signal and an L channel audio signal, the R channel audio signal is supplied to the signal bus 10*a* via Vol1, and the L channel audio signal is supplied to the signal bus 10*a* via SW3 and Vol2.

Further, an audio signal coming through SW2 is separated into an R channel audio signal and an L channel audio signal, the R channel audio signal is supplied to the signal bus 10*a* via SW4 and Vol4, and the L channel audio signal is supplied to the signal bus 10*a* via Vol3.

SW3 and SW4 are linked to the mode switching switch 22 provided on the back of the amplifier unit 10. When the user switches the mode switching switch 22 to the stereophonic side, both SW3 and SW4 are switched ON, and when the user switches the mode switching switch 22 to the monophonic side, both SW3 and SW4 are switched OFF. When SW3 is switched ON, both the R channel audio signal and the L channel audio signal coming through the microphone/line input terminal 16 are supplied to the signal bus 10*a* via Vol1 and Vol2. Further, when SW4 is switched ON, both the R channel audio signal and the L channel audio signal coming through the microphone/line input terminal 18 are supplied to the signal bus 10*a* via Vol3 and Vol4. When both SW3 and SW4 are switched OFF, only the R channel audio signal coming through the microphone/line input terminal 16 is supplied to the signal bus 10*a* via Vol1, and only the L channel audio signal coming through the microphone/line input terminal 18 is supplied to the signal bus 10*a* via Vol3. These two monophonic signals in a pair are processed as a stereophonic audio signal.

It should be noted that although the input terminal switching switch 20 and the mode switching switch 22 may be formed as mutually separate, independent switches, they may also be formed as mutually linked switches. Specifically, they may be configured such that when the input terminal switching switch 20 is set to one of the microphone/line input terminals 16 and 18, the mode switching switch 22 is disabled (one of the microphone/line input terminals 16 and 18 is set to the stereophonic input), and when the mode switching switch 22 is set to the stereophonic mode, the input terminal switching switch 20 is disabled to select both the terminals 16 and 18 (both the microphone/line input terminals 16 and 18 are set to the monophonic input). In this case, when one of SW1 and SW2 is switched ON, both SW3 and SW4 are set to the ON state, and when both SW1 and SW2 are switched ON, both SW3 and SW4 are set to the OFF state.

Figure 10:
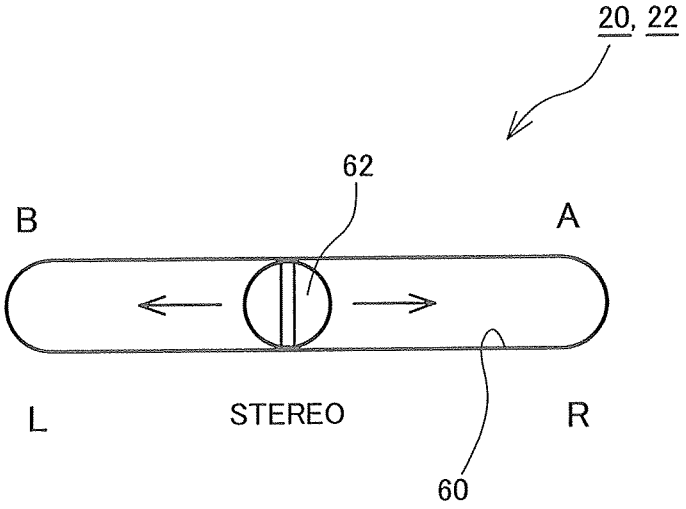
FIG. 10 illustrates the structure of a switching switch.

FIG. 10 shows an example of the input terminal switching switch 20 and the mode switching switch 22. The input terminal switching switch 20 and the mode switching switch 22 are composed of a single three-way switch. A slide knob 62 is provided within a horizontally elongated opening 60, and the user can move the slide knob 62 to the right and to the left. When the slide knob 62 is slid to the right end of the opening 60, the switch is switched and set to the microphone/line input terminal 16 side (denoted by A in FIG. 10), and when the slide knob 62 is slid to the left end of the opening 60, the switch is switched and set to the microphone/line input terminal 18 side (denoted by B in FIG. 10). On the other hand, when the slide knob 62 is slid to the central position of the opening 60, the switch is switched and set to the stereophonic mode, and both the microphone/line input terminal 16 and the microphone/line input terminal 18 are set to the monophonic input. In this case, an audio signal coming through the microphone/line input terminal 16 is processed as an R channel signal, and an audio signal coming through the microphone/line input terminal 18 is processed as an L channel audio signal (in FIG. 10, the side A is denoted as R, and the side B is denoted as L).

Returning again to FIG. 6, Vol1 to Vol4 are linked to the input volume control 14 provided in the amplifier unit 10, and adjust levels of input audio signals. The input volume control 14 is composed of two volume control knobs, of which a first volume control knob actuates Vol1 and Vol2, and a second volume control knob actuates Vol3 and Vol4. However, under normal conditions, the two volume control knobs rotate in a mutually linked manner. As such, Vol1 to Vol4 adjust levels of audio signals in a mutually linked manner. On the other hand, the two volume control knobs can also rotate independently without being linked to each other. In this case, Vol1 and Vol2 adjust levels of audio signals independently of Vol3 and Vol4, and Vol3 and Vol4 adjust levels of audio signals independently of Vol1 and Vol2. The structure of the input volume control 14 will be further described below.

The ADC 10*b* converts a stereophonic audio signal coming through the signal bus 10*a* into a digital signal, and outputs the resultant signal to the DSP 10*c*.

The DSP 10*c* adjusts the tone by applying equalizer processing to the digital stereophonic audio signal (for example, effect processing may be performed), and outputs the resultant signal via the I/F 10*d*.

The I/F 10*d* constitutes a part of the connector 12, and outputs the digital stereophonic audio signal which has been processed by the DSP 10*c*, to the mobile electronic device 100.

For the circuit structure as described above, operation will next be described.

A case in which a user attaches an external stereophonic microphone to the microphone/line input terminal 16 will be described below. In this case, the user switches the input terminal switching switch 20 to the microphone/line input terminal 16 side. Then, SW1 is switched ON, and SW2 is switched OFF, so that a stereophonic audio signal, namely a signal constituted by an R channel audio signal and an L channel audio signal coming through the microphone/line input terminal 16, is input. During this operation, SW3 is basically kept in the ON state. When the user operates the input volume control 14, levels of the R channel audio signal and the L channel audio signal are respectively adjusted at Vol1 and Vol2, and the resultant signals are supplied to the signal bus 10*a*. The ADC 10*b* converts the stereophonic audio signal into a digital signal to produce a digital stereophonic audio signal, and supplies the resultant signal to the DSP 10*c*. The DSP 10*c* applies equalizer processing to the digital stereophonic audio signal, and outputs the resultant signal to the mobile electronic device 100 via the I/F 10*d*. By operating the mobile electronic device 100, the user can record the digital stereophonic audio signal of high sound quality output from the amplifier unit 10.

A case in which a user attaches an external stereophonic microphone to the microphone/line input terminal 18 will be described below. In this case, the user switches the input terminal switching switch 20 to the microphone/line input terminal 18 side. Then, SW1 is switched OFF, and SW2 is switched ON, so that a stereophonic audio signal, namely a signal constituted by an R channel audio signal and an L channel audio signal coming through the microphone/line input terminal 18, is input. During this operation, SW4 is basically kept in the ON state. When the user operates the input volume control 14, levels of the R channel audio signal and the L channel audio signal are respectively adjusted at Vol3 and Vol4, and the resultant signals are supplied to the signal bus 10*a*. The ADC 10*b* converts the stereophonic audio signal into a digital signal to produce a digital stereophonic audio signal, and supplies the resultant signal to the DSP 10*c*. The DSP 10*c* applies equalizer processing to the digital stereophonic audio signal, and outputs the resultant signal to the mobile electronic device 100 via the I/F 10*d*. By operating the mobile electronic device 100, the user can record the digital stereophonic audio signal of high sound quality output from the amplifier unit 10.

A case in which a user attaches an external stereophonic microphone to the microphone/line input terminal 16, and attaches an external stereophonic microphone to the microphone/line input terminal 18 will be described below. In this case, the user switches the input terminal switching switch 22 to the stereophonic side. Then, both SW1 and SW2 are switched into the ON state, and both SW3 and SW4 are switched into the OFF state. From among an R channel audio signal and an L channel audio signal coming through the microphone/line input terminal 16, only a level of the R channel audio signal is adjusted at Vol1, and the resultant signal is supplied to the signal bus 10*a*. Further, from among an R channel audio signal and an L channel audio signal coming through the microphone/line input terminal 18, only a level of the L channel audio signal is adjusted at Vol3, and the resultant signal is supplied to the signal bus 10*a*. It should be noted that when a monophonic microphone is attached to each of the microphone/line input terminals, an audio signal is input from the microphone/line input terminal 16 as an R channel audio signal, and an audio signal is input from the microphone/line input terminal 18 as an L channel audio signal. The ADC 10*b* converts the R channel audio signal coming through the microphone/line input terminal and the L channel audio signal coming through the microphone/line input terminal 18 into digital signals to produce a digital stereophonic audio signal, and supplies the resultant signal to the DSP 10*c*. The DSP 10*c* applies equalizer processing to the digital stereophonic audio signal, and outputs the resultant signal to the mobile electronic device 100 via the I/F 10*d*. By operating the mobile electronic device 100, the user can record the digital stereophonic audio signal of high sound quality output from the amplifier unit 10.

Next, the input volume control 14 of the amplifier unit 10 will be described.

Figure 7A:
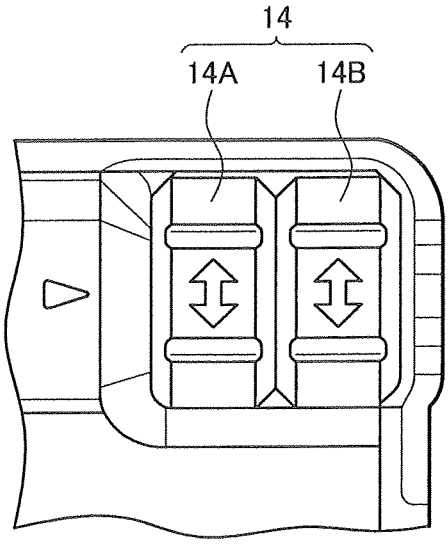
FIG. 7A illustrates linked operation of an input volume control.
Figure 7B:
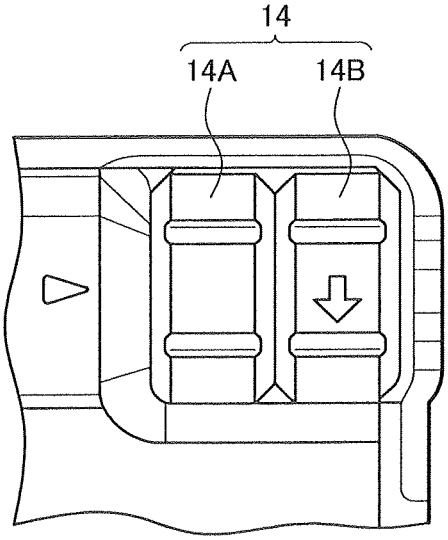
FIG. 7B illustrates independent operation of the input volume control.

FIGS. 7A and 7B show operation of the input volume control 14. The input volume control 14 is composed of two volume control knobs 14A and 14B, of which the volume control knob 14A corresponds to Vol1 and Vol2 on the microphone/line input terminal 16 side, and the volume control knob 14B corresponds to Vol3 and Vol4 on the microphone/line input terminal 18 side. The volume control knob 14A and the volume control knob 14B are in frictional engagement with each other by means of a certain frictional force, and are configured such that rotation of one volume control knob causes the other volume control knob to also rotate in a linked manner. Therefore, as shown in FIG. 7A, when the volume control knob 14A is operated to rotate, the volume control knob 14B also rotates in the same direction in a linked manner, and when the volume control knob 14B is operated to rotate, the volume control knob 14A also rotates in the same direction in a linked manner.

When the user attaches an external stereophonic microphone to the microphone/line input terminal 16, although an input level is adjusted basically by operating the volume control knob 14A corresponding to Vol1 and Vol2 on the microphone/line input terminal 16 side to rotate, because the volume control knobs 14A and 14B rotate in a linked manner in frictional engagement with each other as described above, the user can adjust an input level by operating one of the volume control knobs 14A and 14B to rotate. This also applies to cases where an external stereophonic microphone is attached to the microphone/line input terminal 18, and the user can adjust an input level by operating one of the volume control knobs 14A and 14B to rotate.

On the other hand, because the volume control knobs 14A and 14B are in frictional engagement with each other by means of a certain frictional force, while one volume control knob is being held in a fixed state, only the other volume control knob can be operated to rotate. In this case, the two volume control knobs 14A and 14B do not move in a linked manner, but rotate in a mutually independent manner. FIG. 7B shows this state. When the volume control knob 14B is rotated while the volume control knob 14A is being fixed by being pressed by a finger, the volume control knob 14A is kept in a fixed state, and only the volume control knob 14B rotates. Then, it is possible to adjust an input level using only Vol3 and Vol4 independently of Vol1 and Vol2. It should be understood that when the volume control knob 14A is rotated while the volume control knob 14B is being fixed by being pressed by a finger, the volume control knob 14B is kept in a fixed state, only the volume control knob 14A rotates, and an input level is adjusted using only Vol1 and Vol2 independently of Vol3 and Vol4.

The above means that the level of an audio signal coming through the microphone/line input terminal 16 and the level of an audio signal coming through the microphone/line input terminal 18 can be adjusted in a mutually independent manner, and the levels of both audio signals can also be adjusted by the same amount in a linked manner. This function is particularly useful when an R channel audio signal coming through the microphone/line input terminal 16 and an L channel audio signal coming through the microphone/line input terminal 18 are paired as a stereophonic signal. More specifically, when an external stereophonic microphone is attached to each of the microphone/line input terminals 16 and 18 to record stereophonic sound, by keeping the volume control knob 14A fixed, and operating only the volume control knob 14B to rotate to adjust only the level of the L channel audio signal coming through the microphone/line input terminal 18 to increase or decrease relative to the R channel audio signal, the user can adjust the balance of the two signals. After that, by operating the volume control knobs 14A and 14B to rotate in a linked manner, the overall level can be easily adjusted to increase or decrease while the balance of the two signals is being maintained.

Figure 8:
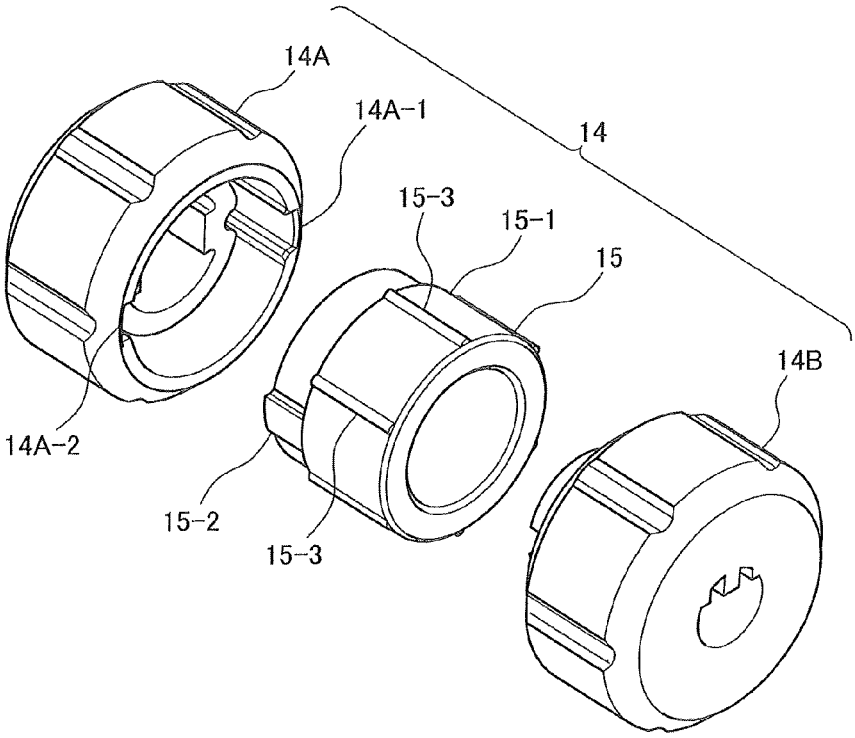
FIG. 8 is an exploded perspective view of the input volume control.
Figure 9:
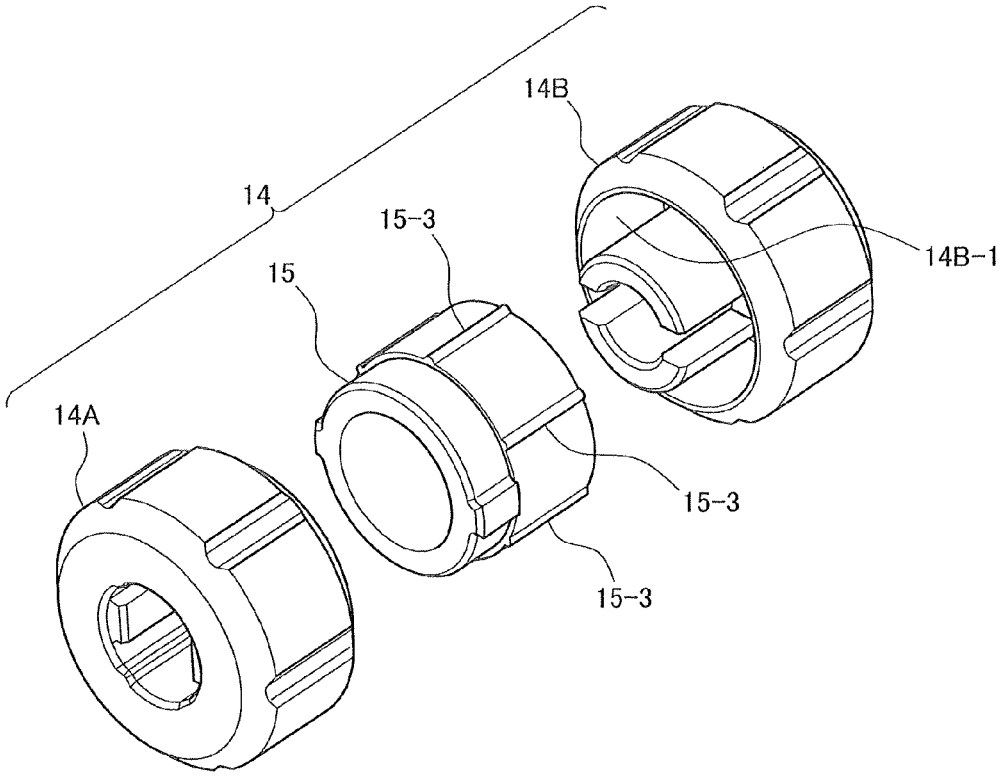
FIG. 9 is an exploded perspective view of the input volume control.

FIGS. 8 and 9 show exploded perspective views of the input volume control 14 respectively as viewed from different directions. As shown in FIGS. 8 and 9, the input volume control 14 is composed of the volume control knobs 14A and 14B and a collar 15. The volume control knob 14A, the collar 15, and the volume control knob 14B are attached, in that order, to shafts of a two-shaft volume control switch. Specifically, the two-shaft volume control switch has a first shaft corresponding to Vol1 and Vol2, and the first shaft is fitted into a shaft hole of the volume control knob 14A. Further, the two-shaft volume control switch has a second shaft corresponding to Vol3 and Vol4, and the second shaft is fitted into a shaft hole of the volume control knob 14B. The volume control knob 14A has, on its inner circumferential surface, key grooves 14A-1 and 14A-2 formed in mutually opposing positions separated by 180 degrees. The collar 15 has, on its outer circumferential surface, on the side closer to the volume control knob 14A, projecting keys 15-1 and 15-2 formed at positions opposing the key grooves 14A-1 and 14A-2. The key 15-1 of the collar 15 is fitted into the key groove 14A-1, and the key 15-2 of the collar 15 is fitted into the key groove 14A-2 so that the volume control knob 14A and the collar 15 are engaged with each other, and the volume control knob 14A and the collar 15 rotate in a mutually linked manner.

On the other hand, the collar 15 has, on its outer circumferential surface, on the side closer to the volume control knob 14B, a plurality of ribs 15-3 formed at regular intervals in the shaft direction of the volume control switch. These ribs 15-3 are in contact with an inner circumferential surface 14B-1 of the volume control knob 14B, and are in frictional engagement with the inner circumferential surface 14B-1 of the volume control knob 14B.

The volume control knob 14A and the collar 15 are in fitted engagement with each other by means of the key grooves 14A-1 and 14A-2 and the keys 15-1 and 15-2, and the collar 15 and the volume control knob 14B are in frictional engagement with each other by means of the ribs 15-3 and the inner circumferential surface 14B-1. As such, the volume control knob 14A and the volume control knob 14B are in frictional engagement with each other with the collar 15 being interposed therebetween.

When the user operates the volume control knob 14A to rotate, the collar 15 rotates in a manner in which it is linked to the rotation of the volume control knob 14A, and the volume control knob 14B also rotates in a manner in which it is linked to the rotation of the collar 15. Similarly, when the user operates the volume control knob 14B to rotate, the collar 15 rotates in a manner in which it is linked to the rotation of the volume control knob 14B, and the volume control knob 14A also rotates in a manner in which it is linked to the rotation of the collar 15. Therefore, both the first shaft and the second shaft of the volume control switch rotate in a linked manner, and a set of Vol1 and Vol2 and a set of Vol3 and Vol4 adjust the input level in a linked manner.

When the user operates the volume control knob 14A to rotate while the volume control knob 14B is being fixed by being pressed by a finger, although the collar 15 rotates in a manner in which it is linked to the rotation of the volume control knob 14A, because the collar 15 and the volume control knob 14B are in frictional engagement with each other, even if the collar 15 rotates, the ribs 15-3 only slide while being in contact with the inner circumferential surface 14B-1 of the volume control knob 14B, and the volume control knob 14B does not rotate. Therefore, only the first shaft of the volume control switch rotates, and only Vol1 and Vol2 adjust the input level.

When the user operates the volume control knob 14B to rotate while the volume control knob 14A is being fixed by being pressed by a finger, only the volume control knob 14B rotates, the collar 15 does not rotate, and the volume control knob 14A also does not rotate. Therefore, only the second shaft of the volume control switch rotates, and only Vol3 and Vol4 adjust the input level.

The input volume control 14 according to the present embodiment has a structure in which the two volume control knobs 14A and 14B are engaged with each other with the collar 15 being interposed therebetween. By employing this structure, it is possible to achieve a state of frictional engagement without any restrictions imposed on material even if it is difficult to process the inner circumferential surfaces of the volume control knobs 14A and 14B because the size of the volume control knobs is reduced to meet the demand for size reduction of the amplifier unit 10.

As described above, according to the present embodiment, the microphone/line input terminals 16 and 18 are respectively provided on different surfaces of the amplifier unit 10, and are configured to switch between processing an audio signal coming through each terminal as a monophonic signal and processing an audio signal coming through each terminal as a stereophonic signal. As such, regardless of orientation of the mobile electronic device 100 to which the amplifier unit 10 is connected, it is possible to reliably output a stereophonic audio signal of high sound quality. Further, because the input volume control 14 includes two volume control knobs 14A and 14B which are basically linked to each other but can also be adjusted independently, it is possible to adaptively adjust the input level in accordance with the switching of the microphone/line input terminals 16 and 18 between monophonic and stereophonic modes. Specifically, when one of the microphone/line input terminals 16 and 18 is used, the volume control knobs 14A and 14B can facilitate adjustment of the input level as they are caused to function as linked volume control knobs, and when both of the microphone/line input terminals 16 and 18 are used, the volume control knobs 14A and 14B can enable balance adjustment of the R channel and the L channel as independent volume control knobs.

It should be noted that although, according to the above-described embodiment, the volume control knob 14A is configured to correspond to Vol1 and Vol2, and the volume control knob 14B is configured to correspond to Vol3 and Vol4 so that the balance of the L channel and the R channel can be adjusted only when both of the microphone/line input terminals 16 and 18 are used, the volume control knob 14A may be configured to correspond to Vol1 and Vol4, and the volume control knob 14B may be configured to correspond to Vol2 and Vol3 so that the balance of an L channel audio signal and an R channel audio signal can be adjusted independently, not only when both of the microphone/line input terminals 16 and 18 are used, but also when one of them is used.

Further, although, according to the above-described embodiment, the amplifier unit 10 is described as a unit connected to the mobile electronic device 100 via the connector 12, the amplifier unit 10 may be incorporated as an amplifier unit or module integrated into the mobile electronic device 100. For example, the amplifier unit 10 may be incorporated as an integrated module in a mobile phone, or incorporated as an integrated module in a digital camera. When an amplifier unit is incorporated as an integrated module in a mobile phone, it is only required that the microphone/line input terminals 16 and 18 be provided on at least two different surfaces of the mobile phone. This similarly applies to a case where an amplifier unit is incorporated as an integrated module in a digital camera. It is preferable that the microphone/line input terminals 16 and 18 be provided on surfaces which correspond to two different orientations of operation of a mobile electronic device, and which respectively are topside surfaces when the mobile electronic device is held in a first orientation of operation (for example, in portrait orientation) and in a second orientation of operation (for example, in landscape orientation).

What is claimed is:

1. An amplifier unit comprising:

first and second audio signal input terminals respectively formed on at least two different surfaces, and to each of which an audio signal of an external device connected to each terminal is input;

switching means that changes input states of an audio signal coming through the first audio signal input terminal and an audio signal coming through the second audio signal input terminal;

analog-to-digital conversion means for converting an audio signal coming through the switching means into a digital audio signal; and output means for outputting the digital audio signal, wherein, when a microphone is connected to one of the first audio signal input terminal and the second audio signal input terminal and the audio signal input terminal to which the microphone is connected is set to a stereophonic input, the switching means switches to process a signal coming through the input terminal to which the microphone is connected, as a stereophonic signal, and when microphones are connected to both of the first audio signal input terminal and the second audio signal input terminal and a stereophonic mode is set, the switching means switches to process each of signals coming through the first audio signal input terminal and the second audio signal input terminal to which the microphones are connected, as a monophonic signal, and outputs a pair of a monophonic audio signal coming through the first audio signal input terminal and a monophonic audio signal coming through the second audio signal input terminal as a stereophonic audio signal.

2. The amplifier unit according to claim 1, further comprising a connector for connecting the amplifier unit to a mobile electronic device.

3. The amplifier unit according to claim 1, wherein the amplifier unit is incorporated in a mobile electronic device.

4. An amplifier unit comprising:

first and second audio signal input terminals respectively formed on at least two different surfaces, and to each of which an audio signal of an external device connected to each terminal is input;

level adjustment means for adjusting an input level of each of audio signals coming through the first and second audio signal input terminals, the level adjustment means comprising first and second operation knobs which are in frictional engagement with each other, and rotate about the same axis, wherein the first operation knob adjusts an input level of an audio signal coming through the first audio signal input terminal, the second operation knob adjusts an input level of an audio signal coming through the second audio signal input terminal, operation of one operation knob to rotate causes the other operation knob to also rotate correspondingly in a linked manner, and while one operation knob is being kept in a fixed state, the other operation knob is capable of being independently operated to rotate;

switching means capable of switching whether to process each of audio signals coming through the first and second audio signal input terminals as a monophonic audio signal or as a stereophonic signal, wherein, when the audio signals are processed as monophonic audio signals, a monophonic audio signal coming through the first audio signal input terminal and a monophonic audio signal coming through the second audio signal input terminal are paired as a stereophonic audio signal;

audio-to-digital conversion means for converting an audio signal coming through the switching means into a digital audio signal; and output means for outputting the digital audio signal.

5. The amplifier unit according to claim 4, wherein, when switching to a stereophonic signal is performed, the switching means outputs either a signal coming through the first audio signal input terminal or a signal coming through the second audio signal input terminal as a stereophonic signal.

6. The amplifier unit according to claim 4, wherein, when an audio signal coming through either the first audio signal input terminal or the second audio signal input terminal is switched to be a stereophonic signal, the first operation knob of the level adjustment means adjusts an input level of an L channel audio signal coming through either the first audio signal input terminal or the second audio signal input terminal, and the second operation knob of the level adjustment means adjusts an input level of an R channel audio signal coming through either the first audio signal input terminal or the second audio signal input terminal.

7. The amplifier unit according to claim 4, further comprising a connector for connecting the amplifier unit to a mobile electronic device.

8. The amplifier unit according to claim 4, wherein the amplifier unit is incorporated in a mobile electronic device.

* * * * *

UNITED STATES PATENT AND TRADEMARK OFFICE

CERTIFICATE OF CORRECTION

PATENT NO. : 9,197,964 B2
APPLICATION NO. : 13/750856
DATED : November 24, 2015
INVENTOR(S) : Hideaki Gotoh et al.

It is certified that error appears in the above-identified patent and that said Letters Patent is hereby corrected as shown below:

On the title page
Item (71):
"TEAC Corporation, Tami-shi, Tokyo (JP)" should read, --TEAC Corporation, Tama-shi, Tokyo (JP)--.

Signed and Sealed this
Third Day of May, 2016

Michelle K. Lee

Michelle K. Lee
*Director of the United States Patent and Trademark Office*